US007741264B2

(12) United States Patent
Smith et al.

(10) Patent No.: US 7,741,264 B2
(45) Date of Patent: Jun. 22, 2010

(54) SURFACE ACTIVE POLYMERS AS DETERGENTS

(75) Inventors: George A. Smith, The Woodlands, TX (US); Duy T. Nguyen, Houston, TX (US); Katie R. Hand, Spring, TX (US); Samir S. Ashrawi, The Woodlands, TX (US)

(73) Assignee: Huntsman Petrochemical LLC, The Woodlands, TX (US)

( * ) Notice: Subject to any disclaimer, the term of this patent is extended or adjusted under 35 U.S.C. 154(b) by 193 days.

(21) Appl. No.: 10/586,803

(22) PCT Filed: Jan. 25, 2005

(86) PCT No.: PCT/US2005/002490

§ 371 (c)(1),
(2), (4) Date: Jul. 9, 2008

(87) PCT Pub. No.: WO2005/074515

PCT Pub. Date: Aug. 18, 2005

(65) Prior Publication Data

US 2008/0261853 A1 Oct. 23, 2008

Related U.S. Application Data

(60) Provisional application No. 60/540,673, filed on Jan. 30, 2004.

(51) Int. Cl.
*C11D 3/37* (2006.01)

(52) U.S. Cl. ..... 510/475; 510/421; 510/434; 510/477; 510/499

(58) Field of Classification Search ..... 510/421, 510/434, 475, 477, 499
See application file for complete search history.

(56) References Cited

U.S. PATENT DOCUMENTS

| | | | | |
|---|---|---|---|---|
| 4,137,182 | A | 1/1979 | Golinkin | |
| 4,396,513 | A | 8/1983 | Haldeman | |
| 4,626,379 | A | 12/1986 | Buriks et al. | |
| 4,680,339 | A | 7/1987 | Fong | |
| 4,731,419 | A | 3/1988 | Fong | |
| 5,075,390 | A | 12/1991 | Fong | |
| 5,084,520 | A | 1/1992 | Fong | |
| 5,196,486 | A | 3/1993 | Stephenson | |
| 5,726,267 | A | 3/1998 | Howland et al. | |
| 5,843,192 | A | 12/1998 | Kirk et al. | |
| 6,017,994 | A * | 1/2000 | Carter et al. | 524/555 |

(Continued)

OTHER PUBLICATIONS

Yoshimura, Tomokazu, et al. "Preparation and Surface-Active Properties of Telomer-Type Anionic Surfactants from Maleic Anhydride", Jul. 2002.

(Continued)

*Primary Examiner*—Brian P Mruk
(74) *Attorney, Agent, or Firm*—Edward D. Korompai

(57) ABSTRACT

Provided herein are compositions useful as detergents in cleaning a wide variety of substrates, including hard surfaces and laundry. The compositions contain a water-soluble polymer, which is a co-polymer between a polymerizable amide and a second, ethylenically-unsaturated monomer. The polymerizable amide itself is prepared from an amine-capped, alkoxylated alcohol by reaction with maleic acid anhydride. Compositions according to the invention show enhanced cleaning performance and beneficial anti-redeposition properties.

8 Claims, 6 Drawing Sheets

Surface Tension of Alkylamide MethylPEG Copolymer in DI Water

U.S. PATENT DOCUMENTS

| | | | |
|---|---|---|---|
| 6,020,422 | A | 2/2000 | Connors et al. |
| 6,444,747 | B1 | 9/2002 | Chen et al. |
| 2005/0020735 | A1 | 1/2005 | Krappe et al. |

OTHER PUBLICATIONS

Journal of Surfactants and Detergents, vol. 5, No. 3 (Jul. 2002).

Huntsman Technical Bulletin "The Use of Surfonamine(R) Surfactant Amines in Ink and Pigment Applications" Copyright 2003.

Huntsman Technical Bulletin "The Jeffamine(R) Polyoxyalkyleneamines" Copyright 1997.

* cited by examiner

Surface Tension of Alkylamide MethylPEG Copolymer in DI Water

SURFACE ACTIVE POLYMERS AS DETERGENTS

CROSS REFERENCE TO RELATED APPLICATIONS

This application is the National Phase of International Application PCT/US2005/002490 filed Jan. 25, 2005 which designated the U.S. and which claimed priority to U.S. Provisional Application No. 60/540,673 filed Jan. 30, 2004. The noted applications are incorporated herein by reference.

FIELD OF THE INVENTION

The present invention relates to polymers. More particularly, it relates to co-polymers of an ethylenically-unsaturated monomer with at least a second unsaturated monomer which comprises the reaction product of an acid anhydride with an amine-capped, alkoxylated alcohol. The co-polymers of the present invention are useful in a wide range of cleaning end-uses for household and industrial laundry. and other like employments.

DESCRIPTION OF THE RELATED ART

The prior art further includes works in the field of a wide range of different polymeric detergent and dispersant materials. Dispersants are known in the art to be typically describable as surface-active materials with strong affinity for solid surfaces. They may be anionic, nonionic, or even cationic or amphoteric, but all have in common the ability to prevent the agglomeration of particles suspended in a liquid media. Because of the different molecular structure and crystal surface properties present among the many different materials used industrially in suspension form, no single dispersant is ideal for each and every end-use application.

Several different classes of polymers are known to be useful in cleaning products to chelate hard water ions, control rheology, prevent redeposition, assist in soil release, inhibit dye transfer, etc. including without limitation polyacrylate (anti-redeposition) polymers, styrene-maleic anhydride co-polymers (anti-redeposition), carboxymethyl cellulose polymers (anti-redeposition), swellable alkali polymers (rheological control), and poly-vinylpyrollidone polymers (dye transfer inhibition).

As it is desirable to minimize manufacturing costs, there is a continual need for new, cost-effective high performance dispersants in field of laundry detergents.

Polymers are currently and commonly used in formulated cleaning products to chelate hard water ions, control rheology, inhibit $CaCO_3$ crystal growth, prevent redeposition of soil, and inhibit dye transfer. The surface-active polymers in the present invention are believed capable of performing many of the functions of traditional polymers, in addition to improving detergency and modifying the surface properties from hydrophobic to hydrophilic, and vise versa.

The present invention provides surface-active polymers which improve soil and stain detergency in formulated liquid detergents. The surface-active polymers of the invention are not only capable of chelating hard water ions, but also improve stain and soil detergency and modify surfaces to give soil resistance or easier cleaning upon subsequent washes. Careful manipulation of polymer architecture also allows for the possibility of fiber surface modification for soil resistance or easier cleaning upon subsequent washes. The materials provided by this invention are applicable as ingredients in household laundry applications and hard surface cleaners.

BRIEF SUMMARY OF THE INVENTION

The present invention provides detergent formulations which comprise polymeric materials which include in their polymer chain a moiety having the general chemical structure of:

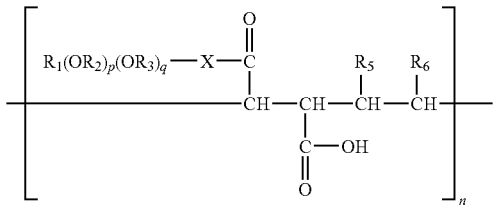

in which X is selected from the group consisting of: oxygen and —N—$R_4$—, the sum of p and q is any value between about 0 and about 100, including 0 and 100, wherein $R_1$ is independently selected from the group consisting of: hydrogen, and any $C_1$ to $C_{20}$ alkyl group; $R_2$ and $R_3$ may each be the same or different, and when the same they are selected from the group consisting of: any $C_1$ to $C_6$ alkyl group, and when $R_2$ and $R_3$ are different they are each independently selected from the group consisting of: any $C_1$ to $C_6$ alkyl group; $R_4$ is independently selected from the group consisting of: hydrogen, and any $C_1$ to $C_6$ alkyl group; $R_5$ and $R_6$ are each independently selected from the group consisting of: H, —CN, —$CONH_2$ (amide), —$COOR_7$ (ester), —$CO_2H$, —$COO^-$, and

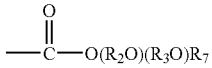

in which $R_7$ is selected from the group consisting of: hydrogen, methyl, and ethyl; and wherein n is at least one, and wherein the weight-average molecular weight of said polymer of any value in the range of between about 3,000 and 100,000, and including salts thereof.

In another embodiment, the present invention provides a composition of matter useful as a detergent which comprises:

a) a first component which is a polymer that is formed from the co-polymerization of:

i) a first monomer having the structure:

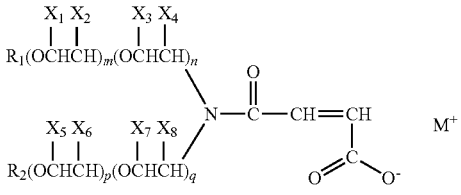

in which $R_1$ and $R_2$ are each independently selected from the group consisting of: hydrogen, and any $C_1$ to $C_{24}$ hydrocarbyl group; $X_1$, $X_2$, $X_3$, $X_4$, $X_5$, $X_6$, $X_7$, $X_8$ in each occurrence are each independently selected from the group consisting of: hydrogen, ethyl, and methyl; $M^+$ is selected from the group consisting of: hydrogen, alkali metal ions, an alkaline earth metal ions, ammonium ions, alkyl-substituted ammonium ions, and hydroxyalkyl-substituted ammonium ions; m, n, p, q are each independently any integer in the range of between 0 and about 50, including 0 and 50, subject to the proviso that at least one of m, n, p, q are not zero; and ii) a second monomer, which is an ethylenically-unsaturated monomer; and b) one or more second component(s) selected from the group consisting of: fatty acids, esters, alkyl sulfates, alkanolamines, amine oxides, alkali carbonates, water, ethanol, isopropanol, pine oil, sodium chloride, citric acid, citrates, cationic surfactants, anionic surfactants, non-ionic surfactants, nitriloacetic acid, sodium silicate, polymers, alcohol alkoxylates, zeolites, alkali sulfates, hydrotropes, dyes, fragrances, preservatives, polyacrylates, essential oils, alkali hydroxides, alkylaromatic sulfonates, ether sulfates, alkylphenol alkoxylates, fatty acid amides, alpha olefin sulfonates, alkylbenzene sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, glycols, ethers, methyl ester sulfonates, alkyl polysaccharides, N-methyl glucamides, alkylated sulfonated diphenyl oxide, and polyethylene glycols.

The ethylenically-unsaturated monomer may be any material which contains a carbon-carbon double bond, and which is recognized by those skilled in the art as being capable of functioning as a monomer in a polymerization reaction. Preferred ethylenically-unsaturated monomers include the monomers: acrylic acid, methacrylic acid, acrylamide, styrene, alpha-methylstyrene, butyl acrylate, and ethylhexyl acrylate.

DETAILED DESCRIPTION OF THE INVENTION

Figure 1:
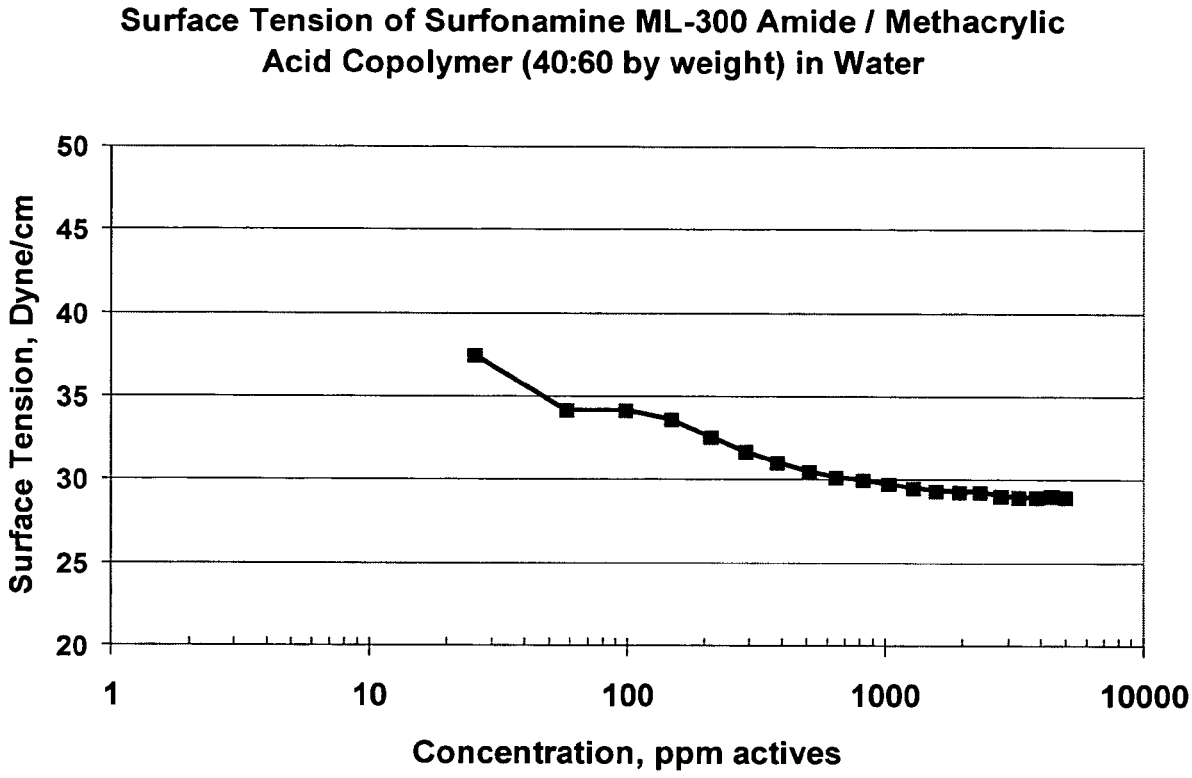
FIG. 1 shows a plot of the surface tension of an aqueous solution of a polymer according to one embodiment of the present invention as a function of concentration.

The anionic surface-active water soluble polymers provided by the present invention are preferably prepared by co-polymerizing a monomer mixture which comprises at least one polymerizable amide that is itself formed from one or more polyetheramines (a.k.a., polyoxyalkyleneamines, such as JEFFAMINE® polyetheramines available from Huntsman, and imitations thereof), with other monomers having ethylenic or allylic unsaturation to form polymers that exhibit surface activity which is on-par with that of traditional surfactants. The polymerizable amide(s) useful as a monomer from which a polymeric surfactant may be prepared are preferably produced by reacting the polyetheramines with an unsaturated acid anhydride, including without limitation maleic anhydride.

The anionic polymers provided herein are soluble in water and exhibit surface-active properties analogous to nonionic surfactants, such as low critical micelle concentration (CMC) and low surface tension in aqueous solution. The anionic surface-active water soluble polymers are prepared by copolymerizing polymerizable amides based on polyetheramines with other monomers having vinylic or an allylic moiety to form polymers that exhibit surface activity that is on par with traditional surfactants. The polymerizable amides are preferably made by reacting the polyetheramines with maleic anhydride. These polymerizable amides can be hydrophilic or hydrophobic in nature. For example, a hydrophobic Surfonamine® ML-300 amine is reacted with maleic anhydride to form an amide, thus:

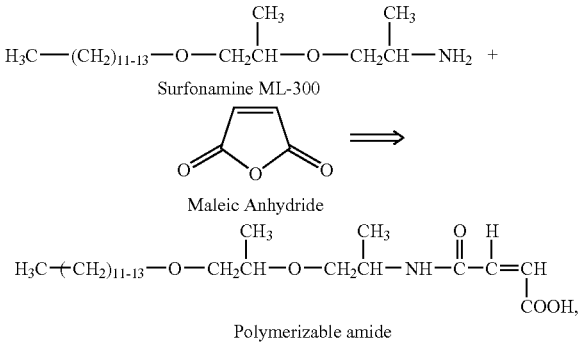

which polymerizable amide is subsequently copolymerized with one or more suitable hydrophilic monomers, including without limitation monomers such as methacrylic acid, acrylic acid, and acrylamide, to form a surface-active polymer, which may be neutralized by addition of a basic substance, viz:

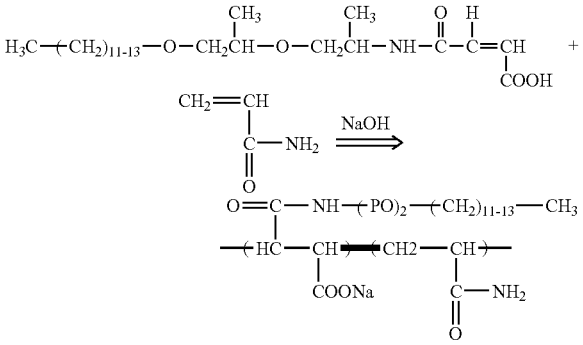

The surface-active copolymers of the invention are preparable by conventional polymerization techniques. Factors that affect the molecular weight of the product include the amount of the initiator, the amount of the chain transfer agent (e.g., isopropyl alcohol), the reaction time, etc. We prefer to use ammonium persulfate or sodium persulfate as an initiator but organic peroxide and azo initiators can also be employed.

A random co-polymer according to one alternate embodiment of the invention has the structure:

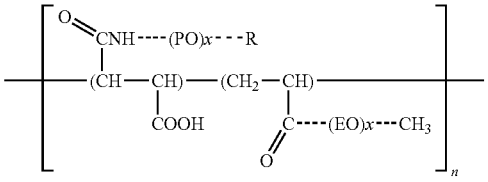

in which "PO" represents propylene oxide, "EO" represents ethylene oxide, x is about 2 to 20; R is as previously defined, and in which sufficient amounts of monomeric raw materials are employed to yield a material having a molecular weight in the range of between about 3,000 and 100,000. The first monomer in the above co-polymer is prepared from maleic acid anhydride and SURFONAMINE® ML-300 amine, and the second monomer in this co-polymer is prepared from a polyethylene glycol having a methyl end cap ("MPEG") and acrylic acid.

A random co-polymer according to another alternate embodiment of the invention has the structure:

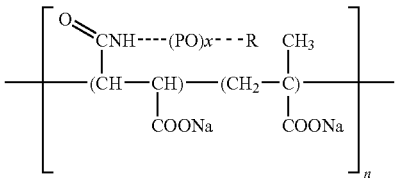

in which "PO" represents propylene oxide, and in which sufficient amounts of monomeric raw materials are employed to yield a material having a molecular weight in the range of between about 3,000 and 100,000. The first monomer in the above co-polymer is prepared from maleic acid anhydride and Huntsman's ML-300™ amine (product of reaction of maleic anhydride with Huntsman's SURFONAMINE® C-300), and the second monomer in this co-polymer is methacrylic acid. This is the neutralized form of the polymer.

Thus, in a general sense, the present invention provides detergent formulations which comprise polymers made by copolymerizing a mixture of monomers which comprise a first monomer which comprises at least one ethylenically-unsaturated monomer and a second monomer described by the formula:

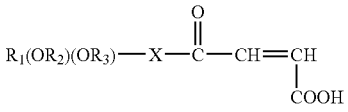

in which X is selected from the group consisting of: oxygen and —$NR_4$—, wherein $R_1$ is independently selected from the group consisting of: hydrogen, and any $C_1$ to $C_{20}$ alkyl group; $R_2$ and $R_3$ are each independently selected from the group consisting of: any $C_1$ to $C_6$ alkyl group; and $R_4$ is independently selected from the group consisting of: hydrogen, and any $C_1$ to $C_6$ alkyl group. The at least one ethylenically-unsaturated monomer is preferably selected from the group consisting of: acrylic acid, acrylamide, alkyl acrylates, alkyl alkacrylates, ethyl acrylate, methyl methacrylate, allyl alcohol, and acrylonitrile.

Thus, the polymers useful as surfactants according to one embodiment of the present invention are described by the general formula:

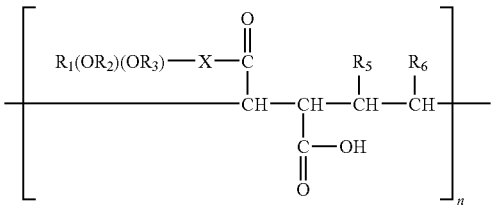

in which in which X is selected from the group consisting of: oxygen and —$NR_4$—, wherein $R_1$ is independently selected from the group consisting of: hydrogen, and any $C_1$ to $C_{20}$ alkyl group; $R_2$ and $R_3$ are each independently selected from the group consisting of: any $C_1$ to $C_6$ alkyl group; $R_4$ is independently selected from the group consisting of: hydrogen, and any $C_1$ to $C_6$ alkyl group; $R_5$ and $R_6$ are each independently selected from the group consisting of: H, —CN, —$CONH_2$ (amide), —$COOR_7$ (ester), —$CO_2H$, —$COO^-$, and

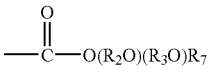

in which $R_7$ is selected from the group consisting of: hydrogen, methyl, and ethyl; and wherein n is sufficient to yield a weight average molecular weight of said polymer of any value in the range of between about 3,000 and 100,000.

A composition according to one preferred form of the invention includes one or more polymers as herein described, in addition to one or more other components that are known by those of ordinary skill in the art to be useful in formulating soaps, cleaning compositions, hard surface cleaners, laundry detergents, and the like. For purposes of this invention and the appended claims, the words "other components known to be useful in formulating soaps, detergents, and the like" means any material which a formulator of ordinary skill in the soap or detergent arts recognizes as adding a benefit to the physical performance, aroma, or aesthetics of a combination that is intended to be used as a cleaning composition, regardless of the substrate that is intended to be cleansed. Such definition includes without limitation: fatty acids, esters, alkyl sulfates, alkanolamines, amine oxides, alkali carbonates, water, ethanol, isopropanol, pine oil, sodium chloride, citric acid, citrates, nitriloacetic acid, sodium silicate, polymers, alcohol alkoxylates, zeolites, alkali sulfates, hydrotropes, dyes, fragrances, preservatives, polyacrylates, essential oils, alkali hydroxides, alkylaromatic sulfonates, ether sulfates, alkylphenol alkoxylates, fatty acid amides, alpha olefin sulfonates, alkylbenzene sulfonates, paraffin sulfonates, betaines, chelating agents, tallowamine ethoxylates, polyetheramine ethoxylates, ethylene oxide/propylene oxide block copolymers, alcohol ethylene oxide/propylene oxide low foam surfactants, glycols, ethers, methyl ester sulfonates, alkyl polysaccharides, N-methyl glucamides, alkylated sulfonated diphenyl oxide, and polyethylene glycols.

The examples which now follow shall be construed as exemplary of the present invention, and not delimitive thereof.

Example 1

Preparation of Polymerizable Amide from Surfonamine® ML-300 and Maleic Anhydride (a.k.a. "ML-300 Amide")

In a round bottom flask, 300 g (1.0 mole) of Surfonamine® ML-300 amine is heated to 60° C. (or until liquid). Half of the stoichiometrically-required amount of ground/powdered maleic anhydride ("MA") is slowly added and then stirred until the exotherm kicks in (approx. 10-15 minutes). Then the remainder of the MA powder is slowly added keeping the temperature below about 70° C. After addition, the contents of the flask are held at about 70° C. for at least one hour and then acid number titrations (phenolphthalein) are obtained (mg KOH/mole) using dry acetone in one titration and dry isopropanol in separate titrations, as solvents, with sufficient heating to enable the isopropanol solvent to react with excess maleic anhydride present. The acid number is checked every 30 minutes until subsequent readings are stable to an acid number variance of less than about 3 typically taking about 2 hours total time. The expected acid value is in the range of about 150, and the difference in acid numbers should be about 5-10. If necessary, more MA is added so as to put the acid number obtained using acetone as solvent about 5-10 higher than the acid value when using isopropanol as solvent.

Example 2

Preparation of ML-300 Amide (Example 1)/Methacrylic Acid Copolymer (40% ML-300 Amide:60% Methacrylic Acid by Weight)

A 3-necked 1-L flask is fitted with a mechanical stirrer, heating mantle, thermometer, reflux condenser, addition inlet, and provision for maintaining an inert atmosphere within the reaction vessel, such as a nitrogen inlet. The flask is charged with 142 grams of isopropanol and 104 grams of water. Heating is commenced under stirring and slow nitrogen sweep until a gentle reflux is achieved, at about 80° C. A first stream comprising 74 grams of a 10% aqueous sodium persulfate solution was slowly added to the refluxing contents of the flask simultaneously with a second stream comprising a liquid mixture of 38 grams of ML-300 amide monomer (Example 1) and 57 grams of methacrylic acid, over the course of about 2 hours. Subsequently, an additional 15 grams of 10% sodium persulfate was added and the temperature maintained at reflux for 1 hour to ensure complete reaction. To prepare a water-soluble salt of a copolymer, namely the ammonium salt, the flask was set up for distillation by affixing a head and condenser. The flask is heated until the azeotrope of isopropanol and water begins to distill and then 143 grams of 28% ammonium hydroxide aqueous solution is slowly added to the flask during the distillation at a rate which is approximately equal to the rate at which the azeotrope is being distilled. When the temperature reaches 98-101° C., the flask is allowed to cool to 50° C. and 128 grams of water is added to adjust a total solids content to about 22%. FIG. 1 shows the surface tension curve of an aqueous solution of the copolymer so produced. As can be seen, the polymer behaves like a surfactant and exhibits surface tension values of 30 dyne/cm at 1000 pm and 29 dyne/cm at 5000 ppm.

Example 3

Preparation of ML-300 Amide (Example 1)/Methacrylic Acid Copolymer (50% ML-300 Amide:50% Methacrylic Acid by Weight)

Figure 2:
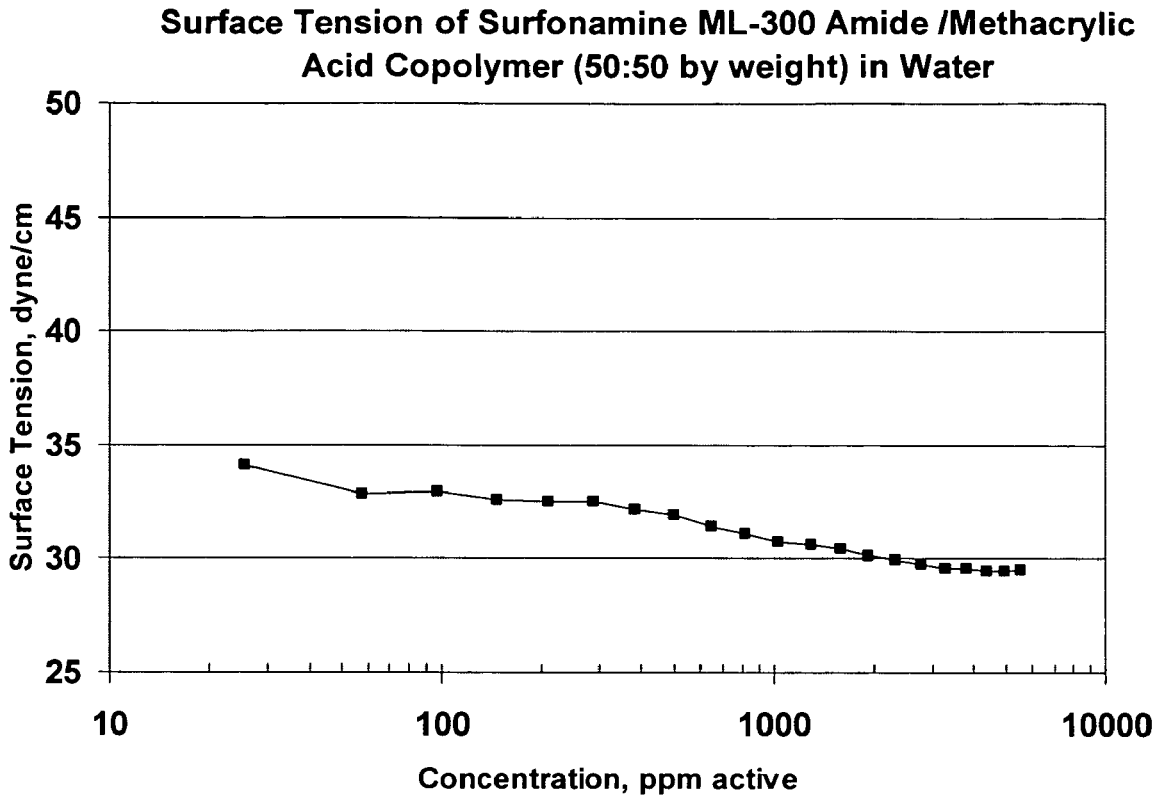
FIG. 2 shows a plot of the surface tension of an aqueous solution of a polymer according to another embodiment of the present invention as a function of concentration.

By the same procedure described in Example 2, 51 grams ML-300 amide and 51 grams methacrylic acid are copolymerized in isopropanol (151 grams) and water (110 grams) with 78 grams of 10% sodium persulfate aqueous solution. The polymer is neutralized with 107 grams triethanol amine (TEA) and about 136 grams of water is added at the end to obtain a solids level of about 44%. The surface tension curve for this copolymer is shown in FIG. 2. This co-polymer results in lower surface tension values at low concentrations than the copolymer produced according to Example 1. Again, the copolymer is quite surface-active as reflected by the low surface tension of its aqueous solution.

Example 4

Preparation of ML-300 Amide (Example 1)/Acrylamide Copolymer (50% ML-300 Amide:50% Acrylamide by Weight)

Figure 3:
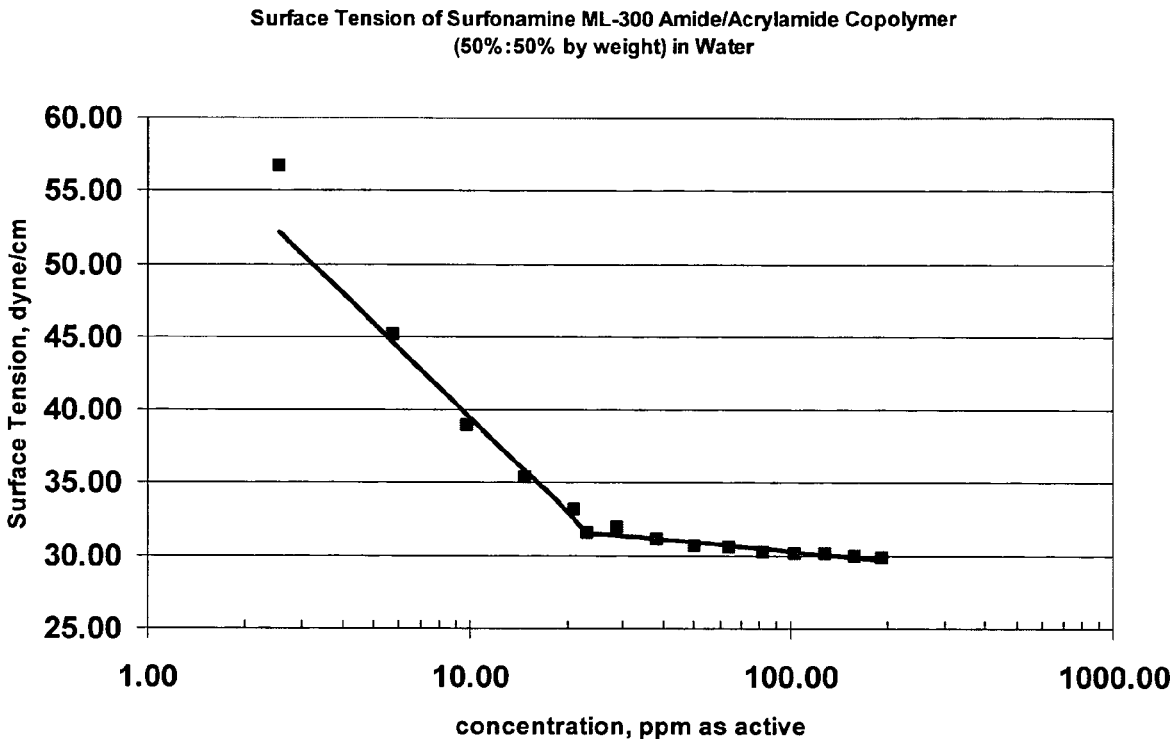
FIG. 3 shows a plot of the surface tension of an aqueous solution of a polymer according to another embodiment of the present invention as a function of concentration.

By the same procedure described in Example 2, 58 grams ML-300 amide and 58 grams methacrylic acid are copolymerized in isopropanol (173 grams) and water (127 grams) with 90 grams of 10% sodium persulfate aqueous solution. The polymer is neutralized with 22 grams triethanol amine (TEA) and about 156 grams of water is added at the end to obtain a solids level of about 31%. FIG. 3 shows the surface tension of this copolymer in water. This copolymer shows a distinct critical micelle concentration (CMC) at a very low concentration (23 ppm) and exhibits a minimum surface tension of 30 dyne/cm.

Example 5

Preparation of ML-300 Amide (Example 1)/Methoxy PEG of Methacrylic Acid Copolymer (30/70 by Weight)

Figure 4:
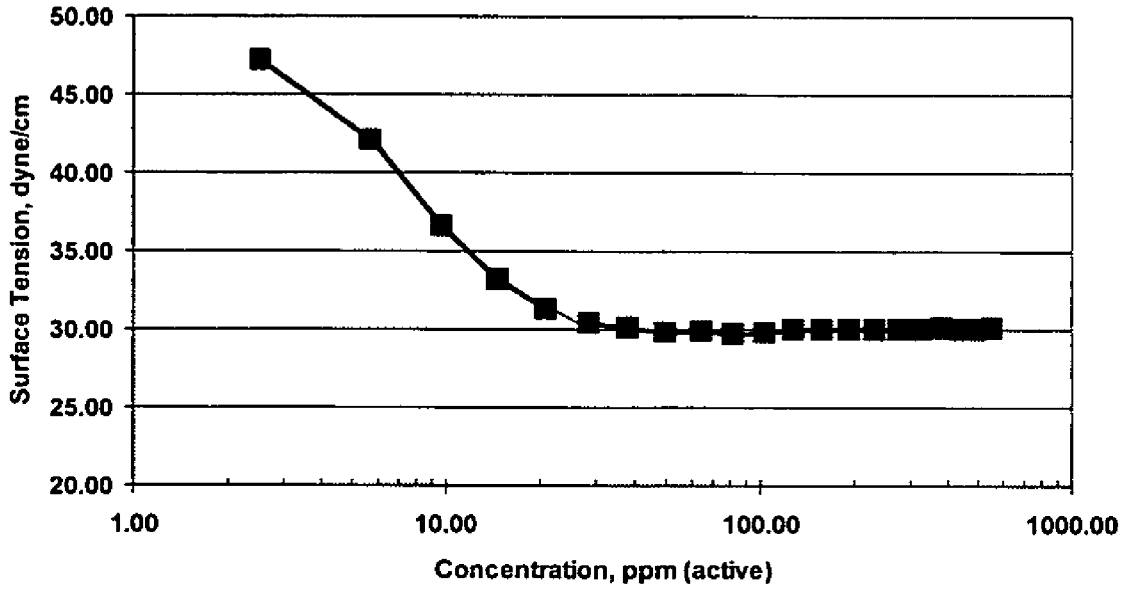
FIG. 4 shows a plot of the surface tension of an aqueous solution of a polymer according to another embodiment of the present invention as a function of concentration.

30 grams of Surfonamine® ML-300 amide, 70 grams of methoxy PEG methacrylic acid, and 100 grams of propylene glycol were combined in a flask and stirred under nitrogen. The mixture was heated to 115° C. and 8 grams of solution containing tert-butyl perbenzoate and butanol at 1:1 ratio by weight was added slowly over 1 hour. The reaction was digested at 115° C. for 2 hours, then stripped at 100° C. for 1 hour under vacuum. The surface tension of an aqueous solution of this copolymer is shown in FIG. 4. The cmc is about 30 ppm and the minimum surface tension is about 30 dyne/cm.

The effect of different polymers on soil and stain removal in a simple laundry pre-treatment formulation was determined. Samples were prepared using 8% tridecyl alcohol (TDA) ethoxylate with 8 moles of ethylene oxide. Four different polymers were evaluated at a level of 1% active polymer. A material we prefer to term "C-300 acrylate" was prepared reacting C-300 detergent product (an amine available from Huntsman LLC Houston, Tex.) with maleic anhydride, and copolymerizing the resulting product with methacrylic acid to yield a polymer (molecular weight c.a. 10,000 $M_n$ avg.) with a hydrophilic backbone and hydrophobic grafts. HARTOMER® (SC-107 copolymer product (available from Huntsman LLC Houston, Tex.) is a random copolymer prepared using styrene and methacrylic acid. TERSPERSE® 2500 surfactant is product available from Huntsman LLC Houston, Tex. ALCOSPERSE® 757 is a random copolymer of styrene and acrylic acid produced by Alco Chemical. The physical properties of each sample are given below. HARTOMER®SC-107 samples gave good results on oxidizable stains (red wine, tea, fruit juice). The amounts of substances are specified in grams. All of these mixtures appeared to be clear fluids.

| | CONTROL | Huntsman C-300 acrylate | HARTOMER ® SC-107 | TERSPERSE ® 2500 surfactant | ALCOSPERSE ® 757 polymer |
|---|---|---|---|---|---|
| TDA-8 | 8 | 8 | 8 | 8 | 8 |
| polymer | 0 | 4.55 | 3.57 | 2.75 | 2.50 |
| $H_2O$ | 92 | 87.45 | 88.43 | 89.25 | 89.50 |
| Total | 100 | 100.00 | 100.00 | 100.00 | 100.00 |
| pH | 6.58 | 8.66 | 8.12 | 8.76 | 8.45 |
| viscosity (cps @ 25° C.) | 3 | 7.00 | 8.00 | 5.00 | 2.00 |

The material listed as TDA-8 is tridecyl alcohol, which has been ethoxylated to contain an average of about 8 moles of ethylene oxide per molecule.

Each of the solutions was tested as a laundry pretreatment on dust sebum, EMPA 101 & 104 (olive oil), red wine and grass on both cotton and poly/cotton. 1 gram of each solution was applied directly to the soil and allowed to stand 5-10 minutes. Each soil swatch was added to a terge pot at 100° F. and 150 ppm water hardness. The swatches were washed for 10 minutes, rinsed, and dried. The reflectance (L of Lab) difference before and after washing was taken as a measure of cleaning performance.

Figure 5:
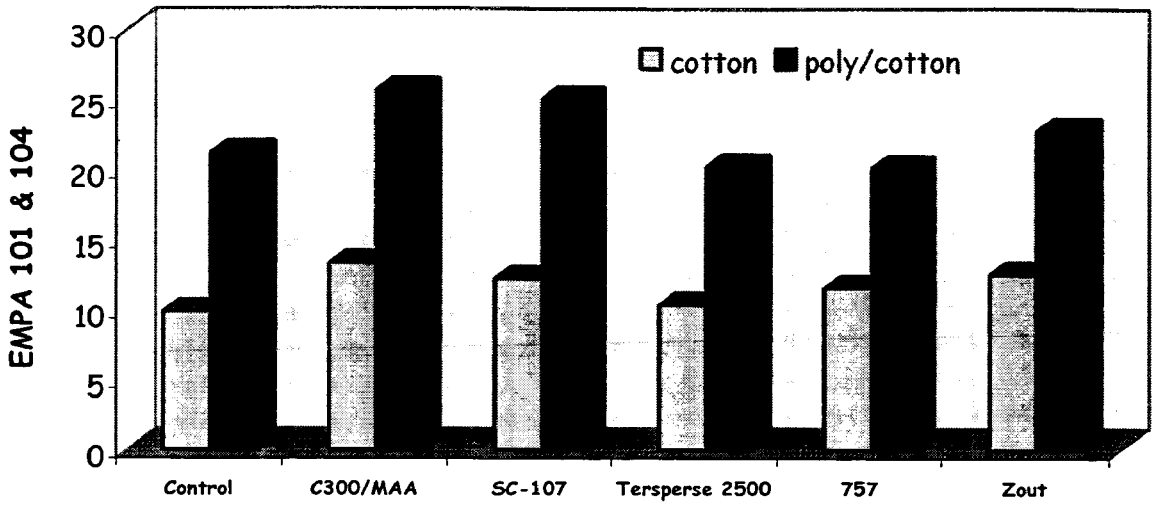
FIG. 5 is a plot comparing the differential in reflectance between samples of red-wine tainted laundry substrates treated using the materials of the present invention and materials of prior art.

The cleaning performance of the samples on EMPA 101 & 104 (Olive oil based soil) is shown in FIG. 5. As a reference, ZOUT® pretreatment (available from the Dial Corporation of Arizona) was included in the evaluation. The higher the bar, the better the cleaning performance. Compared to the control, the C-300 acrylate and HARTOMER® SC-107 gave a noticeable improvement in soil removal on poly/cotton.

Figure 6:
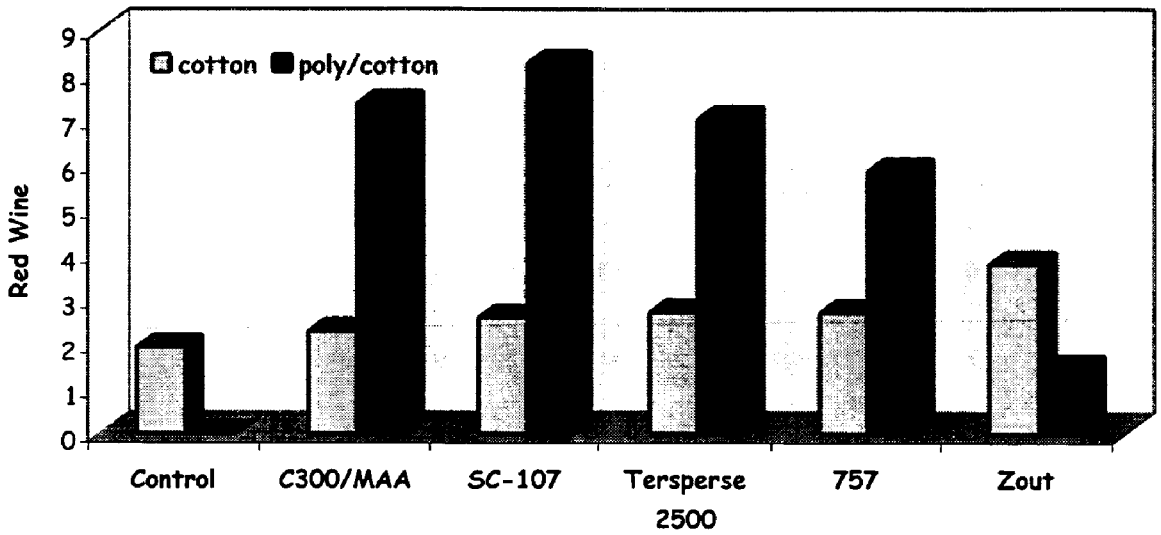
FIG. 6 is a plot comparing the differential in reflectance between samples of EMPA 101 and 104 standardized laundry substrates treated using the materials of the present invention and materials of prior art.

The cleaning performance on red wine is shown in FIG. 6. The C300 Acrylate and HARTOMER® SC-107 shown excellent stain removal on poly/cotton although all of the polymers tested showed an improvement relative to the control and ZOUT® pre-spotter.

The following preparations are exemplary of the versatility of the present invention. by changing various ratios and quantities of materials present, one of ordinary skill in this art may produce a myriad of final compositions according to the invention containing the polymers we have provided for use in these and other like-kind formulations.

Example 6

Preparation of ML-300 Amide (example 1)/Methacrylic Acid Copolymer (67% ML-300 amide:33% Methacrylic Acid by Weight)

By the same procedure described in Example 2, 161 grams ML-300 amide and 79 grams methacrylic acid are copolymerized in isopropanol (357 grams) and water (261 grams) with 93 grams of 10% sodium persulfate aqueous solution. After the two hours, 19 grams of 10% sodium persulfate aqueous solution was added, and the reaction was held at reflux for one hour. The polymer is neutralized with 199 grams triethanolamine (TEA) and about 165 grams of water, and 165 grams of propylene glycol is added at the end to obtain a solids level of about 40%.

Example 7

Preparation of ML-300 Amide (Example 1)/Methacrylic Acid Copolymer (50% ML-300 Amide:50% Methacrylic Acid by Weight)

By the same procedure described in Example 2, 109 grams ML-300 amide and 109 grams methacrylic acid are copolymerized in isopropanol (323 grams) and water (528 grams) with 168 grams of 10% sodium persulfate aqueous solution. After the two hours, 34 grams of 10% sodium persulfate aqueous solution was added, and the reaction was held at reflux for one hour. The polymer is neutralized with 229 grams triethanolamine (TEA). All water was added up front, so no more water is added at the end.

Example 8

Preparation of ML-300 Amide (Example 1)/Methacrylic Acid Copolymer (50% ML-300 Amide:50% Methacrylic Acid by Weight)

By the same procedure described in Example 2, 109 grams ML-300 amide and 109 grams methacrylic acid are copolymerized in isopropanol (323 grams) and water (237 grams) with 168 grams of 10% sodium persulfate aqueous solution. After the two hours, 34 grams of 10% sodium persulfate aqueous solution was added, and the reaction was held at reflux for one hour. The polymer is neutralized with 195 grams of ammonium hydroxide (28% aqueous solution) and about 326 grams of water is added at the end to obtain a solids level of about 40%.

Example 9

Preparation of ML-300 Amide (Example 1)/Methacrylic Acid Copolymer (50% ML-300 Amide:50% Methacrylic Acid by Weight)

By the same procedure described in Example 2, 109 grams ML-300 amide and 109 grams methacrylic acid are copolymerized in isopropanol (323 grams) and water (237 grams) with 168 grams of 10% sodium persulfate aqueous solution. After the two hours, 34 grams of 10% sodium persulfate aqueous solution was added, and the reaction was held at reflux for one hour. The polymer is neutralized with 98 grams of sodium hydroxide (50% solution), and about 326 grams of water is added at the end to obtain a solids level of about 40%.

Example 10

Preparation of ML-300 Amide (Example 1)/Methacrylic Acid Copolymer (50% ML-300 Amide:50% Methacrylic Acid by Weight)

By the same procedure described in Example 2, 109 grams ML-300 amide and 109 grams methacrylic acid are copolymerized in isopropanol (323 grams) and water (236 grams) with 84 grams of 10% sodium persulfate aqueous solution. After the two hours, 17 grams of 10% sodium persulfate aqueous solution was added, and the reaction was held at reflux for one hour. The polymer is neutralized with 229 grams triethanolamine (TEA) and about 243 grams of water, and 150 grams of propylene glycol is added at the end to obtain a solids level of about 40%.

As used in this specification and the appended claims, the word "hydrocarbyl", when referring to a substituent or group is used in its ordinary sense, which is well-known to those skilled in the art. Specifically, it refers to a group having a carbon atom directly attached to the remainder of the molecule and having predominantly hydrocarbon character. Examples of hydrocarbyl substituents or groups include: (1) hydrocarbon (including e.g., alkyl, alkenyl, alkynyl) substituents, alicyclic (including e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); (3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.)

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. The present disclosure includes the subject matter defined by any combination of any one of the various claims appended hereto with any one or more of the remaining claims, including the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claim so modified. This also includes combination of the features and/or limitations of one or more of the independent claims with the features and/or limitations of another independent claim to arrive at a modified independent claim, with the remaining dependent claims in their original text being read and applied to any independent claim so modified. Accordingly, the presently disclosed invention is intended to cover all such modifications and alterations, and is limited only by the scope of the claims which follow, in view of the foregoing and other contents of this specification.

What is claimed is:

1. A composition of matter useful as a detergent which comprises:

a) a first component which is a polymer that is formed from the co-polymerization of:

i) a first monomer having the structure:

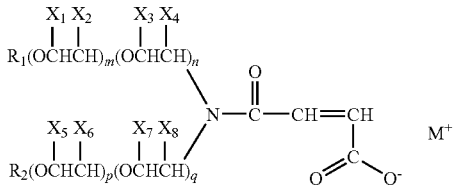

in which $R_1$ and $R_2$ are each independently selected from the group consisting of: hydrogen, and any $C_1$ to $C_{24}$ hydrocarbyl group; $X_1$, $X_2$, $X_3$, $X_4$, $X_5$, $X_6$, $X_7$, $X_8$ in each occurrence are each independently selected from the group consisting of: hydrogen, ethyl, and methyl; $M^+$ is selected from the group consisting of: hydrogen, alkali metal ions, an alkaline earth metal ions, ammonium ions, alkyl-substituted ammonium ions, and hydroxyalkyl-substituted ammonium ions; m, n, p, q are each independently any integer in the range of between 0 and about 50, including 0 and 50, subject to the proviso that at least one of m, n, p, q are not zero; and ii) a second monomer, which is prepared from a polyethylene glycol having a methyl end cap and an ethylenically-unsaturated monomer selected from the group consisting of: acrylic acid and methacrylic acid; and b) one or more second component(s) useful in formulating soaps, cleaning compositions, hard surface cleaners, and laundry detergents.

2. A composition according to claim 1 wherein the weight average molecular weight of said polymer is any value in the range of between about 3,000 and 100,000.

3. A composition according to claim 1 further comprising an effective amount of water for dissolving said polymer, so as to provide an aqueous solution comprising said polymer.

4. An aqueous solution according to claim 3 wherein said polymer is present in any amount between about 0.1 and about 10% by weight based on the total weight of said solution.

5. A composition according to claim 3 wherein p=0, q=0, n=0, m is about 3, $R_2$ is hydrogen; $R_1$ is any $C_8$ to $C_{20}$ hydrocarbyl group; and at least one of $X_1$, $X_2$, $X_3$, or $X_4$ is hydrogen.

6. A composition useful as a detergent which comprises:

a) a polymer having a weight-average molecular weight of any value in the range of between about 3,000 to 100,000, which polymer includes in its structure a plurality of units described by the formula:

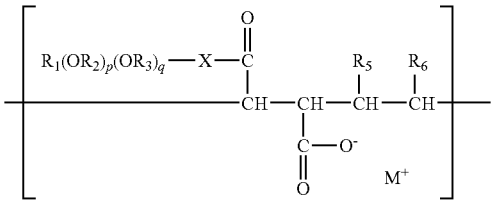

in which X is selected from the group consisting of: oxygen and —$NR_4$—, the sum of p and q is any value between about 1 and about 100, including 1 and 100, wherein $R_1$ is independently selected from the group consisting of: hydrogen, and any $C_1$ to $C_{20}$ hydrocarbyl group; $R_2$ and $R_3$ may each be the same or different, and when the same they are selected from the group consisting of: any $C_1$ to $C_6$ alkyl group, and when $R_2$ and $R_3$ are different they are each independently selected from the group consisting of: any $C_1$ to $C_6$ alkyl group; $R_4$ is independently selected from the group consisting of: hydrogen, and any $C_1$ to $C_6$ alkyl group; $R_5$ is H and $R_6$ is $H^-$

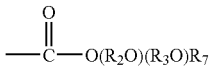

in which $R_7$ is selected from the group consisting of: hydrogen, methyl, and ethyl; and wherein n is sufficient to yield a weight average molecular weight of said polymer of any value in the range of between about 3,000 and 100,000, including salts thereof; $M^+$ is selected from the group consisting of: hydrogen, alkali metal ions, an alkaline earth metal ions, ammonium ions, alkyl-substituted ammonium ions, and hydroxyalkyl-substituted ammonium ions; and b) at least one material useful in formulating soaps, cleaning compositions, hard surface cleaners, and laundry detergents.

7. A composition according to claim 6 further comprising an effective amount of water for dissolving said polymer, so as to provide an aqueous solution comprising said polymer.

8. An aqueous solution according to claim 7 wherein said polymer is present in any amount between about 0.1 and about 10% by weight based on the total weight of said solution.

* * * * *